United States Patent [19]

McCarthy et al.

[11] 4,168,062

[45] Sep. 18, 1979

[54] AUTOMATED GOALIE

[76] Inventors: Gerald F. McCarthy, 38 Meadowview Rd., Milton, Mass. 02186; James A. DiBiasi, 75 Brentwood Rd., Norwell, Mass. 02061

[21] Appl. No.: 857,524

[22] Filed: Dec. 5, 1977

[51] Int. Cl.[2] ..... A63B 69/00

[52] U.S. Cl. ..... 273/1 B

[58] Field of Search ..... 273/1 B, 1 D, 1.5 A, 273/55 R, 85 R, 85 B, 85 E, 85 F

[56] References Cited

U.S. PATENT DOCUMENTS

| | | | |
|---|---|---|---|
| 2,079,136 | 5/1937 | Ontener | 273/85 E |
| 3,391,933 | 7/1968 | Cooper | 273/85 F |
| 3,647,212 | 3/1972 | Barlow et al. | 273/85 B |
| 3,675,921 | 7/1972 | Meyers | 273/1.5 A |
| 3,765,675 | 10/1973 | DiMarzio | 273/1 B |

*Primary Examiner*—Paul E. Shapiro

*Attorney, Agent, or Firm*—Joseph H. Killion

[57] ABSTRACT

An Automated Goalie is disclosed which includes a frame and a goalie body fixedly mounted to the frame. A pair of arms each of which are pivotedly connected to the goalie body and are moveable between a substantially vertical lower position adjacent the goalie body and an upper position outwardly extending from the goalie body and an automating mechanism is connected to the arms to move them between the positions.

9 Claims, 5 Drawing Figures

AUTOMATED GOALIE

BACKGROUND OF THE INVENTION

Hockey, like all sports, requires constant practice to sharpen the skills necessary for one to be proficient.

One of the skills basic to the game of hockey is shooting the puck, and the best target is a live goalie in front of a hockey goal.

Shooters have refined the "slap-shot" to the point where they drive the puck at over 90 miles per hour. This poses a significant risk for the goalie in that he is quite likely to sustain injury under a constant barrage of hockey pucks travelling at this speed, particularly if there is more than one shooter, as there would be in a practice situation. A number of artificial goalie devices have been patented. There are, however, serious disadvantages with these devices.

U.S. Pat. No. 3,840,288 discloses a hockey goalie combined with Y-shaped goal tender. A stationary goalie-board device is disclosed having several cut-outs, at the corners and in the center of the goalie-board device. The shooters aims for the cut-outs.

U.S. Pat. No. 3,856,298 discloses a device similar to the above mentioned in that it consists of a stationary goalie-board member. Again there are cut-outs in various locations for the shooter to aim at.

The prior art discloses, basically, goalie-board devices which do not simulate any live activity. Shooters might practice on an open goal for all the skill it gives them with regard to scoring on a live and active goalie.

There is then a need for an automated goalie which simulates live activity to save wear and tear on the team's actual goalie, to economically utilize expensive ice time and to develop the shooters' scoring skills against an active goalie.

SUMMARY OF INVENTION

Our invention relates to an automated goalie.

We have discovered an automated goalie which comprises a frame and a goalie body adapted to said frame. A first arm means is pivotedly connected to one side of said goalie body and is moveable between a first substantially vertical lower position, adjacent said goalie body, and a second substantially horizontal upper position outwardly extending from said goalie body. Automating means for said first arm means are mounted to said frame and include a motor, gear-reduction means connected to and driven by said motor, and camming means connected to said gear-reduction means on one end, and on the other end to said first arm means to move between a first substantially horizontal lower position, adjacent said goalie body and a second substantially vertical upper position outwardly extending from said goalie body.

We prefer that one automated goalie includes a second arm means made from a tough material, particularly a plastic and more particularly a polycarbonate material and that the second arm means be adapted to the goalie body opposite the first arm means. This second arm means is moveable between a substantially horizontal lower first position adjacent said goalie body and a second substantially vertical upper position outwardly extending from said goalie body.

We prefer that this second arm means be combined with the goalie-stock and that it be pivotable at the shoulder point and at the wrist point to simulate actual arm movement in the first instance and to allow proper stick action and contact with the surface of the ice without disrupting the goalie in the other. It is recognized that there are alternatives to our preferred automation such as pivoting the second arm means at the shoulder point and at the elbow, but it is obvious that these are merely mechanical alternatives which do not depart from the scope and spirit of our invention.

Automating means are connected thereto.

It is recognized that other materials, such as aluminum or glass-reinforced polyester may be utilized for the second arm means.

Preferably the frame includes a shock-absorbing means, particularly a resilient shock-absorbing means and more particularly a rubber shock-absorbing means, to absorb vibrations set up in the goalie body by pucks making contact with it.

Preferably roller means, particularly wheel means, are rotatably positioned to the bottom of the hockey stick to prevent sticking and guide the hockey-stick along the particular surface on which the automated goalie sits.

We prefer that the goalie body be made from a tough material such as polycarbonate material. In the preferred embodiment the polycarbonate is backed by a goalie decal and is reinforced with plywood to strengthen the goalie body. It is recognized that other materials such as glass-reinforced polyester or aluminum may be utilized for the goalie body.

The frame should be a strong and heavy material, particularly a metal, and more particularly steel, to both adequately support the machinery and stabilize the automated goalie.

The automating means will be described in detail in the preferred embodiment where a camming system utilizing substantially symmetrical cam hubs is disclosed. It is recognized and within the scope of the invention that non-symmetrical cam hubs may be utilized to obtain a different motion in said first and second arm means.

We prefer that the first arm means more fully described in the preferred embodiment be made from a tough material, such as polycarbonate material and be pivotable at the elbow portion to realistically simulate the action of a live arm. We prefer that the first arm means be combined with the goalie glove.

Our invention provides numerous advantages over the devices found in the prior art.

It is an advantage of our invention to provide the action simulating a live and active goalie. The movements in the arm means are constantly changing the protected area of the goal mouth which forces the shooter to concentrate on the goalie and not on some fixed definite spot as in the prior art.

Another advantage of our invention is that the glove arm assembly pivots at the elbow, closely resembling human arm movement.

Further advantages of my invention are that it can be used by a number of shooters at the same time, that it is secure and stable while in use, economical and simple to manufacture.

DETAILED DESCRIPTION OF THE DRAWINGS

Figure 1:
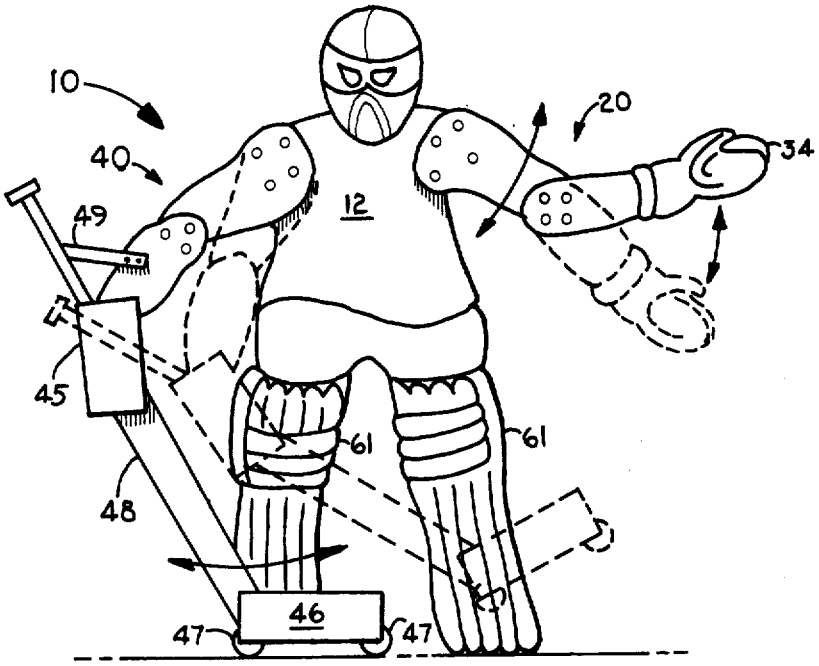
FIG. 1 is a perspective front view of the automated goalie according to the invention.

Referring now in particular to the accompanying drawings. Our automated goalie is generally indicated in FIG. 1 at 10, and includes plywood reinforced polycarbonate goalie body 12. Left arm assembly 20, and right arm assembly 40, are pivotedly engaged to said goalie body.

Goalie mitt 34 adapts to the end of the left arm assembly.

Right arm assembly includes hockey stick 48, blade 46, and rollers 47. Deflector 45, is affixed to the end of said right arm assembly. Hockey-stick support 49, is fixedly mounted on one end to said right arm assembly and on the other end to said hockey-stick.

Goalie pads 61, are adapted to said goalie body at the lower portion thereof.

Figure 4:
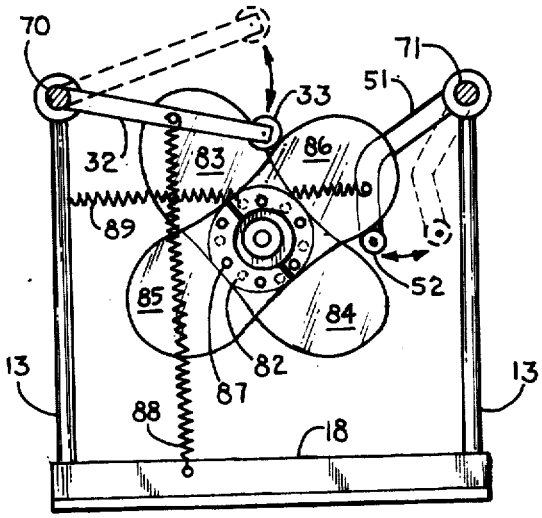
FIG. 4 is an illustrative rear view of the automated goalie showing details of the support and gear-reduction means.

Referring now to FIG. 4. The frame is indicated at 13, and is bolted to frame supports 14 and 15. Support angles 16 and 17 (not shown) are bolted to the goalie body at one end and at the other end to the frame supports. A lower frame support 18, and upper frame support 19, aid in stabilizing the frame and supporting the machinery.

The left arm pivot rod 70, and the right arm pivot rod 71, each including rubber shock-absorber 72, and washer 73, are pivotedly mounted to their respective arm assemblies and rotatably adapted to said frame. Left arm pivot 74 (not shown) and right arm pivor 75, (not shown) are bolted to their respective arm assemblies, between said goalie body and said left arm assembly and said right arm assembly respectively.

The right arm assembly generally indicated at 40, includes upper right arm 39, bolted to right forearm 41. Right hand 42, is pivotedly engaged by right hand pivot 38, (not shown) to said right forearm, and joined to deflector 45, by first deflector support 43. Second deflector support 44 (not shown), connects said deflector to said hockey-stick 48.

Figure 3:
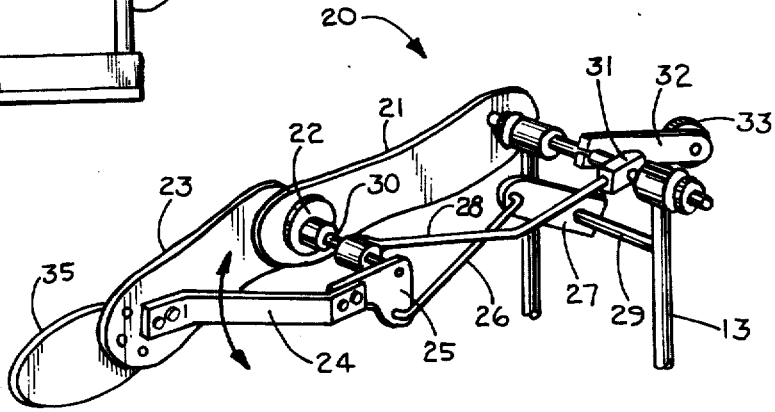
FIG. 3 is a fragmented illustrative view showing details of the first arm assembly.

The left arm assembly 20 is more fully indicated in FIG. 3 and includes upper left arm 21, pivotedly engaged at left forearm pivot 22, to left forearm 23. Left forearm pivot rod 30, pivotedly engaged at one end to said left forearm pivot 22, is connected on the other end to upper left arm activator rod 28, and left forearm activator plate 27, is adapted to offset pivot rod 29, fixedly mounted to frame 13. Forearm support 24 is fixedly mounted on one end to forearm activator plate 25, and on the other end to left forearm 23. Upper left arm activator rod 28, is connected to left arm pivot rod 70, by left arm activator rod calmp 31.

Figure 2:
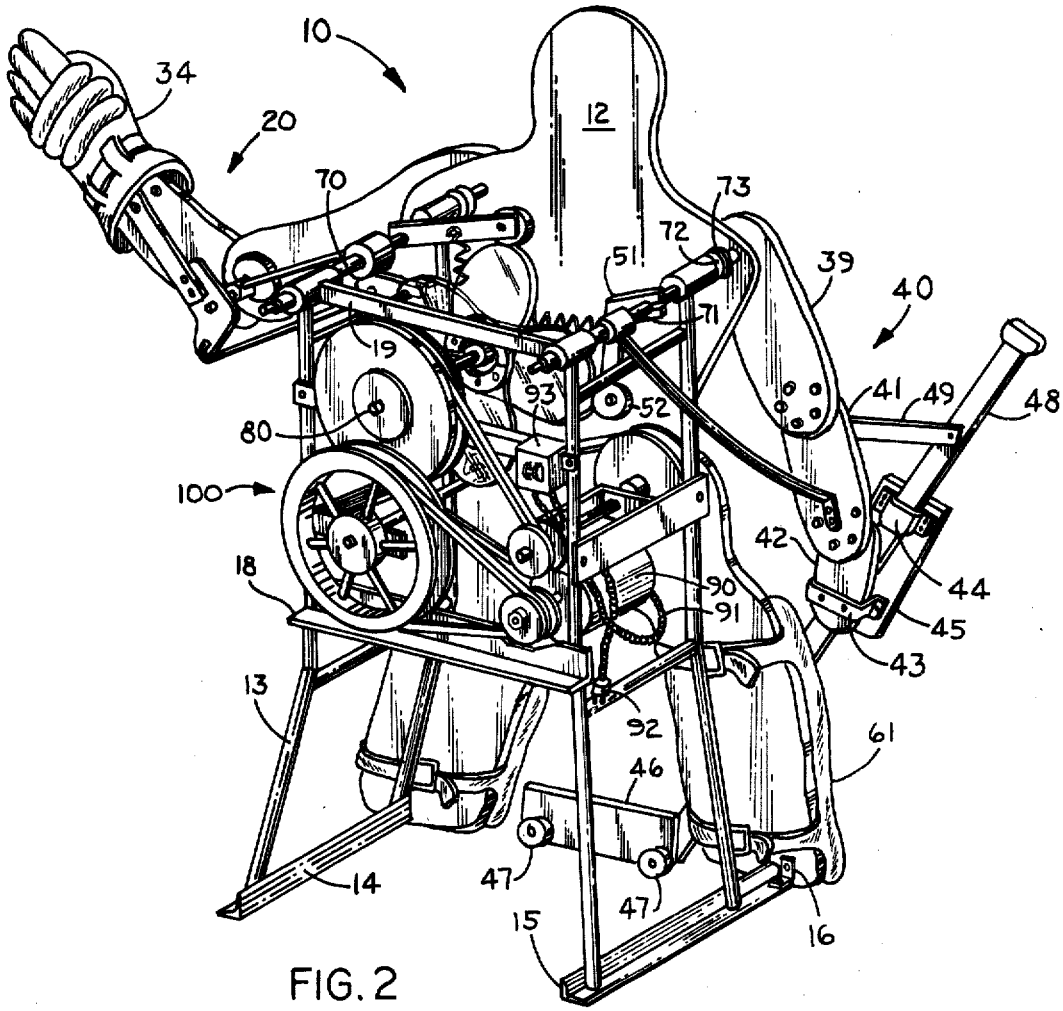
FIG 2 is a cut-away view along 4—4 of FIG. 2 showing details of the camming system.

Referring to FIG. 2, motor 90, (a standard ½ horsepower motor providing approximately 1760 rpms) is bolted to said frame and supported by lower frame support 18 and includes electrical cord 91, having electrical plug 92, for connecting to a standard electrical outlet. On/off switch 93, is adapted to the frame. Gear reduction assembly 100 reduces the revolutions per minute from approximately 1750 rpm to approximately 60 rpm, closely proximating human motion in the arm assemblies. Cam shaft 80 is rotatably connected to said gear reduction assembly and activates the camming system.

FIG. 4 illustrates the camming system around cam shaft 80, and includes cam plate 81, having a multiplicity of threaded holes 82. Closely adapting cam hubs 83 and 84, are detachably mounted to said cam plate on one side by bolts 87, which are threadingly engaged in the holes in said cam plate. Left arm assembly cam follower 32, including cam roller 33, follows cam hubs 83 and 84, as cam shaft 80, rotates, thereby transmitting motion to said left arm assembly. Closely adapting cam hubs 84, 85, and 86, are detachably mounted by bolts 82, to the other side of said cam plate. Right arm assembly cam follower 51, including right arm assembly cam roller 52, follows closely adaption cam humbs 85 and 86, as they rotate about cam hub 80, thereby imparting motion to right arm assembly 40.

Left cam spring 88 attached to cam follower 32, at one end, and affixed to lower frame support 18, at the other end, aids in the retention of cam follower 32, on said cam hubs. Right cam spring 89 is affixed at one end to right cam follower 51, and on the other end to frame 13, helps retain cam follower 51, on said cam hubs.

Figure 5:
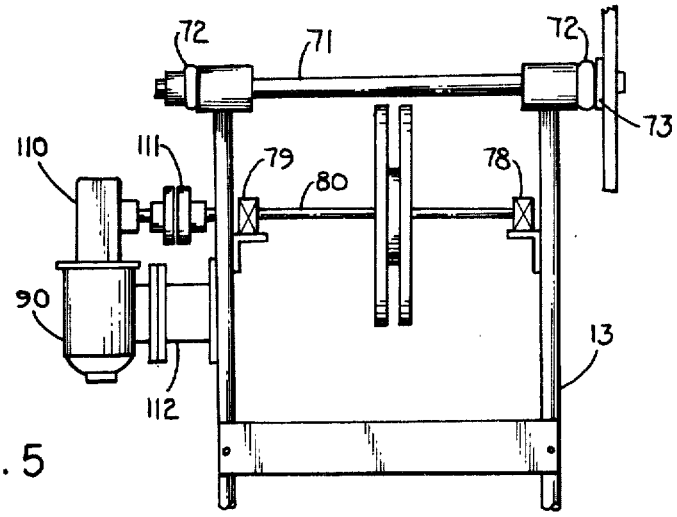
FIG. 5 is an illustrative view of an alternative design for the gear-reduction means.

An alternative embodiment of the gear reduction means is shown in FIG. 5. In place of the standard ½ horsepower motor 90, a gear head motor 110, connects by slip clutch 112, to camshaft 80.

Typically in use plug 92, is connected to a power source. The switch is turned on and the motor activates at approximately 1750 rpms. The revolutions per minute are reduced by the gear reducing assembly to approximately 60 rpms. The cam shaft then rotates at approximately 60 rpms and the cam followers follow their respective cam hubs at this speed.

The left arm cam follower causes the left arm to move between the upper and lower positions and the left forearm to move up and down, pivoting at the left forearm pivot.

The right arm cam follower causes the right arm to move between a position close to the goalie body and one distant the goalie body. As the stick comes closer to the goalie body the back roller takes more of the weight of the hockey-stick and moves it along the ice.

What we claim is:

1. An automated goalie comprising:
   (a) a frame;
   (b) a goalie body fixedly mounted to said frame;
   (c) a pair of arm means each pivotedly connected to said goalie body and moveable between a substantially vertical lower position adjacent said goalie body and an upper position outwardly extending from said goalie body including a first arm means having a goalie glove adapted to the end thereof and a second arm means having a goalie stick adapted to the end thereof;
   (d) means to move said arm means between said positions.

2. An automated goalie as in claim 1 wherein said first arm means further includes:
   (a) an upper arm member;
   (b) a forearm member pivotally connected to said upper arm member;
   (c) pivoting means connecting said upper arm member to said forearm member to move said forearm member between an upper position and a lower position as said first arm means moves between said substantially vertical lower position and said upper position outwardly extending from said goalie body.

3. An automated goalie as in claim 1 wherein said second arm means further includes:

(a) an arm member;

(b) a hand member pivotally connected to said arm member;

(c) pivoting means connecting said arm member to said hand member to permit said hockey stick to strike the surface on which said automated goalie sits without displacing said automated goalie.

4. The automated goalie of claim 3 further comprising:

(a) roller members adapted to the lower portion of said hockey stick to contact rollingly the surface on which said automated goalie rests as said second arm means moves between said positions.

5. The automated goalie of claim 1 wherein the means to move said pair of arm means between said positions further comprises:

(a) a moter;

(b) gear reduction means connected to and driver by said motor;

(c) a pair of camming means rotatably connected to said gear reduction means on one end and at the other end each adapted to one of said pair of arm means to move said arm means between said positions.

6. The automated goalie of claim 5 wherein the camming means further includes:

(a) a camshaft rotatably connected to said gear reduction means;

(b) a cam plate annularly mounted to said cam shaft;

(c) a plurality of cam hubs detachably mounted to said cam plate each of which is in a separate plane;

(d) a pair of pivot rods each of which is connected to one of said pair of arm means on one end thereof and on the other end having a rotatable member thereon abutting the edge of said cam hub to follow the edge of said cam hub as said camshaft rotates thereby moving said pair of arm means between the said positions.

7. The automated goalie of claim 1 further comprising:

(a) means for shock absorbing adapted to said frame to cushion vibrations set up in said goalie body by projectiles striking thereon.

8. The automated goalie of claim 7 wherein said shock absorbing means further comprise:

(a) a pair of resilient members arranged between said frame and said pair of arm means pivotally connected to said goalie body.

9. The automated goalie of claim 8 wherein said pair of resilient members are made of rubber.

* * * * *